US008490454B2

(12) United States Patent
Beltrán de Nanclares Echezarreta et al.

(10) Patent No.: US 8,490,454 B2
(45) Date of Patent: Jul. 23, 2013

(54) MACHINE FOR DRAWING METAL SHEETS

(75) Inventors: Eduardo Beltrán de Nanclares Echezarreta, Vitoria-Gasteiz (ES); David Chico García, Vitoria-Gasteiz (ES); Oscar González Mora, Donostia (ES); Daniel García Chueca, Donostia-San Sebastián (Guipúzcoa) (ES)

(73) Assignee: S. Coop Fagor, Mondragon (ES)

( * ) Notice: Subject to any disclaimer, the term of this patent is extended or adjusted under 35 U.S.C. 154(b) by 391 days.

(21) Appl. No.: 12/961,349

(22) Filed: Dec. 6, 2010

(65) Prior Publication Data

US 2011/0296898 A1 Dec. 8, 2011

(30) Foreign Application Priority Data

Dec. 4, 2009 (ES) ..... 200931122

(51) Int. Cl.
*B21D 11/02* (2006.01)

(52) U.S. Cl.
USPC ..... 72/302; 72/296; 72/305; 72/311

(58) Field of Classification Search
USPC ..... 72/282, 290, 293, 295, 296, 301, 72/302, 304, 305, 308, 309, 311, 316, 318, 72/378, 404, 405.09, 405.11, 405.12, 419, 72/420, 422
See application file for complete search history.

(56) References Cited

U.S. PATENT DOCUMENTS 3,172,528 A * 3/1965 Smith ..... 72/19.8
3,403,542 A * 10/1968 Bova ..... 72/302

(Continued)

FOREIGN PATENT DOCUMENTS

DE 4437872 C1 3/1996
EP 1923150 A1 5/2008

(Continued)

OTHER PUBLICATIONS

Report on the State of the Art for National Patent Application No. 200931122 issued by the Spanish Office of Patents and Trademarks, dated Mar. 14, 2012, pp. 1-5.

(Continued)

*Primary Examiner* — Edward Tolan
(74) *Attorney, Agent, or Firm* — Tim L. Kitchen; Peter B. Scull; Hamilton, DeSanctis & Cha LLP

(57) ABSTRACT

An apparatus for drawing a metal sheet. In one implementation the apparatus includes a fixed head having a first window through which the metal sheet to be drawn may pass and a first holder for holding a first portion of the metal sheet within the first window during a drawing process. The apparatus also includes a moving head that is moveable relative to the fixed head. The moving head has a second window through which the metal sheet to be drawn may pass and a second holder for holding a second portion of the metal sheet within the second window during a drawing process. A support assembly is attached at one end to the fixed head and extends longitudinally through the second window of the moving head. The support assembly forms a part of an actuator assembly that is operable to situate the moving head in different and fixed longitudinal positions relative to the fixed head prior to a drawing process.

16 Claims, 2 Drawing Sheets

U.S. PATENT DOCUMENTS

| | | | | |
|---|---|---|---|---|
| 3,803,899 | A * | 4/1974 | Hertl et al. | 72/420 |
| 4,248,079 | A | 2/1981 | Specktor | |
| 4,751,838 | A | 6/1988 | Voges | |
| 6,205,830 | B1 | 3/2001 | Voges | |
| 6,460,391 | B1 * | 10/2002 | Liefer et al. | 72/302 |
| 7,607,330 | B2 * | 10/2009 | Casal et al. | 72/302 |
| 2008/0034827 | A1 | 2/2008 | Casal et al. | |

FOREIGN PATENT DOCUMENTS

| | | | |
|---|---|---|---|
| GB | 1172243 | A | 11/1969 |
| GB | 2446921 | A | 8/2008 |

OTHER PUBLICATIONS

Report on the State of the Art for National Patent Application No. 200931121 issued by the Spanish Office of Patents and Trademarks, dated Mar. 14, 2012, pp. 1-5.

Report on the State of the Art for National Patent Application No. 200931123 issued by the Spanish Office of Patents and Trademarks, dated Apr. 18, 2012, pp. 1-4.

* cited by examiner

MACHINE FOR DRAWING METAL SHEETS

CROSS-REFERENCE TO RELATED APPLICATIONS

This application relates to and claims the benefit and priority to Spanish Patent Application P200931122, filed Dec. 4, 2009.

TECHNICAL FIELD

This invention relates to apparatus and methods for drawing metal sheets.

BACKGROUND

Metal sheets used in industry to create different shaped pieces by means of pressing, stamping or forming, for example, are provided in the form of coils. These must be uncoiled in order for the metal sheet to be handled and when this is done the sheet features undulations and distortions that are detrimental to its subsequent treatment or handling. In order to solve this drawback the sheet to be unrolled must be handled by a straightening machine where most of the stresses are eliminated. These straightening machines generally comprise a plurality of rollers between which the sheet passes.

This process is suitable for cases in which the sheets comprise a limited thickness. If the thickness exceeds a certain value, the rollers required to eliminate the stresses are very large, making the elimination of stresses in this way difficult. In these cases a drawing machine is used and by means of which the sheet is drawn to eliminate the stresses. This method can also be used for sheets of limited thickness. U.S. Pat. No. 4,751,838 discloses a drawing machine having a first moving head that holds the metal sheet and which is mounted to the floor, and a second moving head that also holds the metal sheet but which moves in relation to the first head by means of actuation means, moving away from the first head. As a result, the sheet is drawn with undulations in it being removed.

In many cases the length of the metal sheet to be drawn varies. As a result of which there are known machines that include means for moving the second head in relation to the first head prior to the drawing operation. As a result, the second head can be positioned in different start positions in relation to the first head, which enables sheets of different lengths to be drawn.

European Patent Application published as EP1923150A1 discloses a drawing machine of this type. The machine structure comprises serrated means and the actuation means comprises connection means that cooperate with the serrated means, so that when they move in relation to the first head they can be fixed in the required position, with the second head moving in conjunction with the actuation means.

SUMMARY

It is an object of the invention to provide a metal sheet drawing machine, wherein the risk of failing to achieve the suitable drawing of the metal sheet is reduced.

In one implementation a machine for drawing metal sheets comprises a fixed head with a window through which a metal sheet to be drawn passes, a moving head with a window through which the metal sheet passes, which moves in relation to the fixed head in order to draw the metal sheet, away from the fixed head, an actuator for causing the movement of the moving head in relation to the fixed head in order to draw the metal sheet, and positioning actuator that cooperates with connection actuator attached to the actuation means to dispose the moving head in a certain position prior to the drawing. In one implementation the machine also comprises a support structure where the positioning actuator is fixed, the support structure being fixed to a front face of the fixed head that faces the moving head at one end, and the floor or a wall at the other end. The support structure also passes through the window of the moving head, so that it is disposed in the proximities of the metal sheet to be drawn. As a result of the proximity, the stresses that the support structure and the heads withstand together during the drawing of a metal sheet affect the metal sheet to a lesser extent, thereby reducing the risk of the metal sheet not being drawn correctly due to distortions caused by the support structure.

According to some implementations an apparatus for drawing a metal sheet is provided that comprises: a fixed head having a first window through which the metal sheet to be drawn may pass and a first holder for holding a first portion of the metal sheet within the first window during a drawing process; a moving head with a second window through which the metal sheet to be drawn may pass and a second holder for holding a second portion of the metal sheet within the second window during a drawing process, the moving head spaced from the fixed head with the second window having an alignment with the first window, the moving head moveable toward and away from the fixed head: a support assembly attached at one end to the fixed head and extending longitudinally through the second window of the moving head; and an actuator assembly comprising the support assembly that is operable to situate the moving head in different and fixed longitudinal positions relative to the fixed head prior to a drawing process.

In some implementations the second window is substantially rectangular and the support assembly comprises first, second, third and fourth longitudinal bars, the first longitudinal bar being parallel with the second longitudinal bar in a horizontal plane and with the third longitudinal bar in a vertical plane, the second longitudinal bar being parallel with the fourth longitudinal bar in the vertical plane, the third longitudinal bar being parallel with the fourth longitudinal bar in the horizontal plane, each of the first, second, third and fourth longitudinal bars being situated at or in close proximity to a corner of the second window.

In some implementations each of the first, second, third and fourth longitudinal bars have an upper surface and a lower surface, the actuator assembly comprises first elements disposed on at least one of the upper and lower surfaces of the first, second, third and fourth longitudinal bars, the actuator assembly further comprising second elements coupled with the moving head, the second elements moveable between a first position and a second position, when in the first position the second elements engage with the first elements to lock the moving head in a longitudinal position relative to the fixed head prior to a drawing process, when in the second position the second elements not engaging the first elements.

According to some implementations an apparatus for drawing a metal sheet is provided that comprises: a fixed head having a first window through which the metal sheet to be drawn may pass and a first holder for holding a first portion of the metal sheet within the first window during a drawing process; a moving head with a second window through which the metal sheet to be drawn may pass and a second holder for holding a second portion of the metal sheet within the second window during a drawing process, the moving head spaced from the fixed head with the second window having an alignment with the first window, the moving head moveable toward and away from the fixed head; a support assembly attached at one end to the fixed head and extending longitudinally through the second window of the moving head; an actuator assembly comprising the support assembly that is operable to situate the moving head in different and fixed longitudinal positions relative to the fixed head prior to a drawing process; and a third head situated between the fixed head and the moving head, the third head having a third window through which the metal sheet to be drawn may pass, the support assembly extending through the third window, the moving head and third head situated on a common moving support that facilitates a common longitudinal movement of the moving and third heads relative to the fixed head, the common moving support also facilitating longitudinal movement of the moving head relative to the third head.

In some implementations the second window is substantially rectangular and the support assembly comprises first, second, third and fourth longitudinal bars, the first longitudinal bar being parallel with the second longitudinal bar in a horizontal plane and with the third longitudinal bar in a vertical plane, the second longitudinal bar being parallel with the fourth longitudinal bar in the vertical plane, the third longitudinal bar being parallel with the fourth longitudinal bar in the horizontal plane, each of the first, second, third and fourth longitudinal bars being situated at or in close proximity to a corner of the second window.

In some implementations each of the first, second, third and fourth longitudinal bars have an upper surface and a lower surface, the actuator assembly comprises first elements disposed on at least one of the upper and lower surfaces of the first, second, third and fourth longitudinal bars, the actuator assembly further comprising second elements coupled with the third head, the second elements moveable between a first position and a second position, when in the first position the second elements engage with the first elements to lock the moving support in a longitudinal position relative to the fixed head prior to the drawing process, when in the second position the second elements not engaging the first elements.

According to some implementations an apparatus for drawing a metal sheet is provided that comprises: a fixed head that is fixed to the floor and which comprises a window through which a metal sheet to be drawn passes; a moving head with a window through which the metal sheet to be drawn passes, which, in order to draw the metal sheet, moves in relation to the fixed head away from the fixed head; an actuator for causing the movement of the moving head in relation to the fixed head; and a positioning actuator that cooperates with connection actuator attached to the moving head to dispose the moving head in a certain position prior to the drawing, the positioning actuator being fixed to a support structure of the machine, the support structure being fixed at one end to the floor or to a wall and at the other end to a front face of the fixed head that faces the moving head, and passing through the window of the moving head.

These and other advantages and characteristics of the invention will be made evident in the light of the drawings and the detailed description thereof.

DETAILED DESCRIPTION

Figure 1:
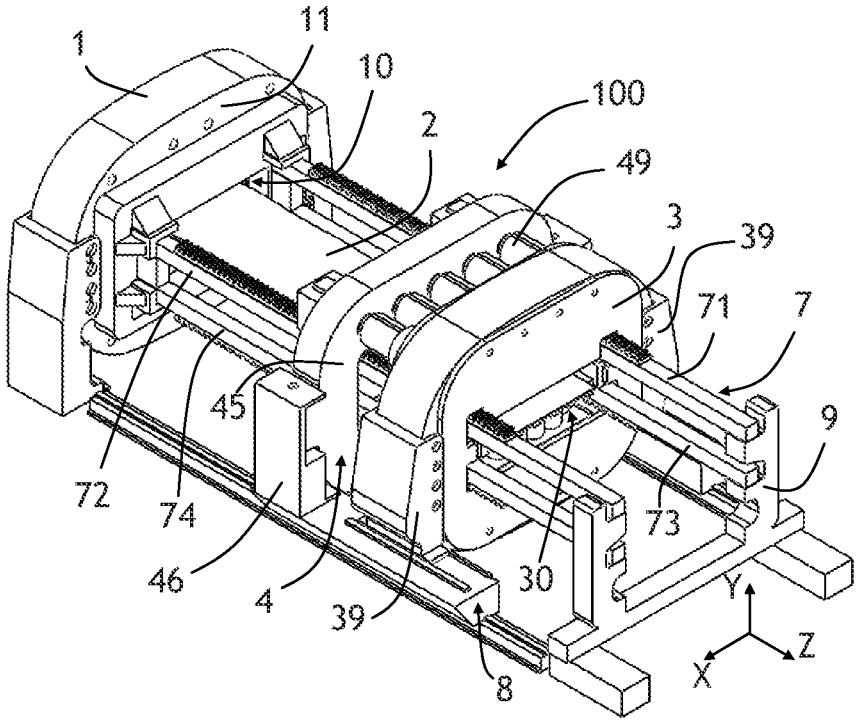
FIG. 1 shows a perspective view of a metal sheet drawing apparatus according to one implementation.
Figure 2:
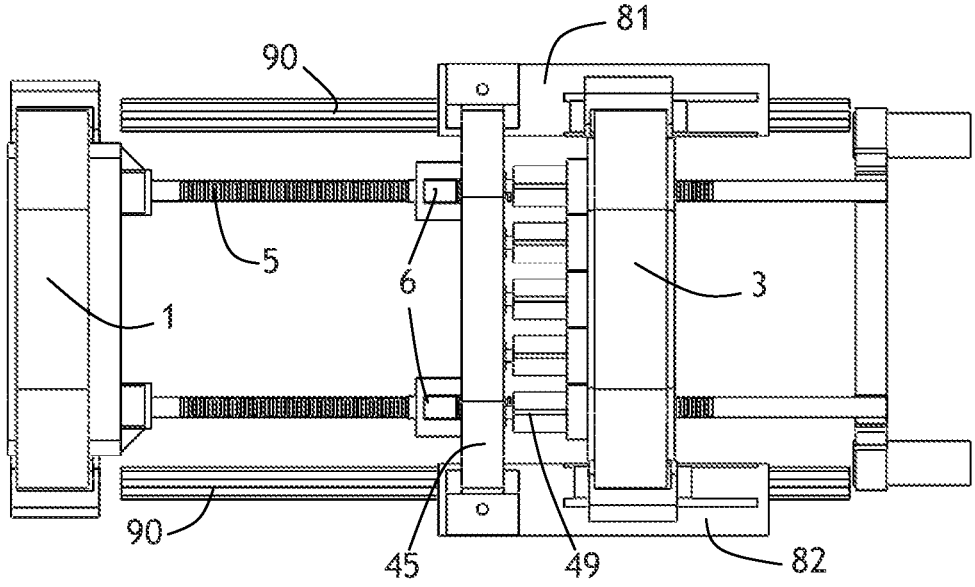
FIG. 2 shows a ground view of the apparatus of FIG. 1.
Figure 3:
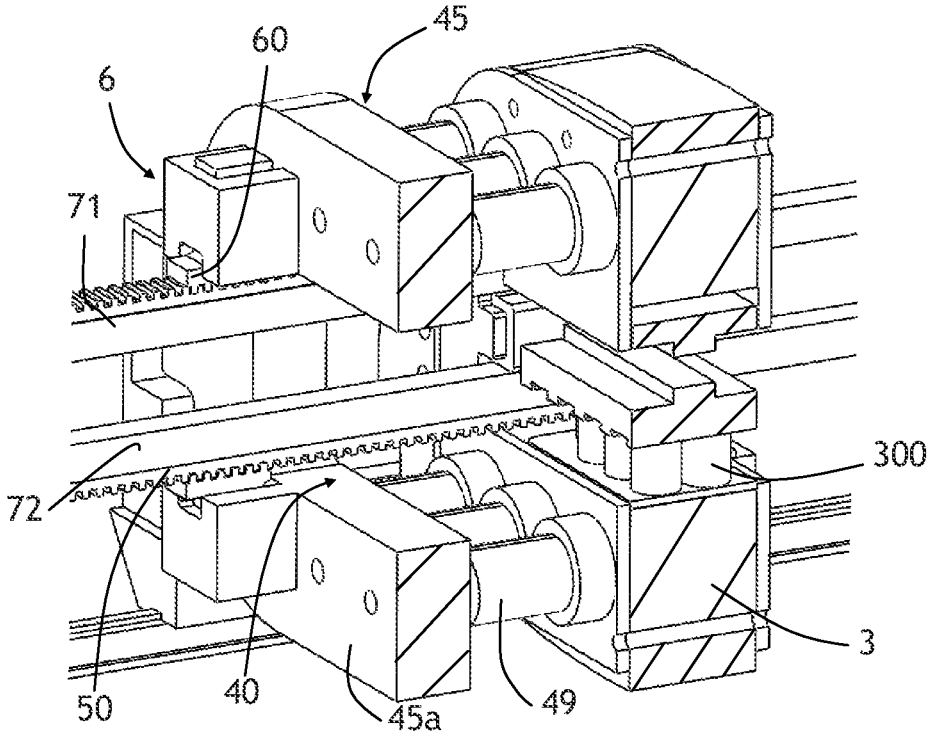
FIG. 3 shows a cross-section and perspective view of the moving head assembly depicted in FIG. 1.

FIG. 1 shows an implementation of a machine 100 for the drawing of metal sheets 2. In one implementation the machine 100 comprises a fixed head 1 that is fixed directly or indirectly to a floor. The fixed head 1 has a window 10 through which a metal sheet 2 to be drawn passes. The machine also has a moving head 3 that includes a window 30 through which the metal sheet 2 passes and which moves in relation to the fixed head 1 in order to draw the metal sheet 2 in a direction such that during the movement the moving head 3 moves away from the fixed head 1, and an actuator 4 for causing the movement of the moving head 3 in relation to the fixed head 1 in order to effect the drawing. Each of heads 1 and 3 include a holder 300 that generally correspond with a plurality of cylinders disposed along the width of the corresponding window 10 and 30 to hold the metal sheet 2 to be drawn along its entire width during the drawing process so that the metal sheet 2 is drawn as the moving head 3 moves away from the fixed head 1. The holder 300, while holding the metal sheet 2, produce forces on the corresponding head 1 and 3, the forces being opposite and opposed to the forces produced by the holding means 300 upon the metal sheet 2.

In some implementations the machine 100 also comprises a position actuator 5 that cooperates with a connection actuator 6 attached, or otherwise coupled, to the moving head 3 to dispose the moving head 3 in a certain position in relation to the fixed head 1 prior to the drawing process, so that the drawing of metal sheets 2 of different lengths is possible. The length of the section of the metal sheet 2 to be drawn depends on the initial distance (a position set by the position actuator 5) between the moving head 3 and the fixed head 1, and the initial distance can be regulated by means of the connection actuator 6 and the position actuator 5.

In some implementations the machine 100 also comprises a support structure 7 that is fixed at one end to a front face 11 of the fixed head 1 that faces the moving head 3, and at the other end to, for example, a floor or to a wall, and which passes through the window 30 of the moving head 3. When the support structure 7 is fixed to the floor, it can be fixed directly to it or by means of, for example, a support 9 as shown in FIG. 1. In one implementation the support 9 prevents the movement of the support structure 7 in the directions X and Y, but does not prevent it in the direction Z. In one implementation the support structure 7 comprises four longitudinal bars 71, 72, 73 and 74 that are grouped together as a pair of upper bars 71 and 72 that are positioned parallel to each other on the horizontal plane and a pair of lower bars 73 and 74 that are positioned parallel to each other on the horizontal plane and parallel in relation to the pair of upper bars 71 and 72 on the vertical plane. In one implementation window 30 is substantially rectangular, each bar 71, 72, 73 and 74 positioned at or in close proximity to a corresponding corner of the window 30. As a result, by means of the position actuator 5 a homogeneous anchoring is provided with stresses being induced upon the metal sheet during the drawing process by the cooperation between the position actuator 5, the support structure 7 and movement between the fixed head 1 and the moving head 3.

In some implementations the positioning actuator 5 is fixed to the support structure 7 or integrated therewith. When a metal sheet 2 is drawn, the heads 1 and 3 flex due to the stresses imposed on them. Part of the stresses originates from the positioning actuator 5 to which they are fixed. In one implementation the support structure 7 is disposed in the proximities of the metal sheet 2 to be drawn, and therefore the positioning actuator 5, so that the stresses that the support structure 7 has to withstand during the drawing of a metal sheet 2 affect the metal sheet 2 to a lesser extent, thereby reducing the risk of the metal sheet 2 not being drawn correctly due to distortions caused by the support structure 7.

In one implementation the positioning actuator 5 comprises a serrated surface 50 disposed on an upper surface or a lower surface of each bar 71, 72, 74, 74 of the support structure 7, and the connection actuator 6 comprises a serrated surface 60 with features that mate with features of serrated surface 50 of the positioning actuator 5, each surfaces 50 and 60 cooperating to position the moving head 3. In one implementation the positioning actuator 5 comprises a serrated surface 50 disposed on an upper surface of the upper bars 71 and 72, and on a lower surface of the lower bars 73 and 74.

In one implementation the machine 100 comprises a moving support 8 that moves in relation to the floor to position the moving head 3 in a certain required position in relation to the fixed head 1 before effecting the drawing of a metal sheet 2, the actuator 4 and the moving head 3 moving in conjunction with the moving support 8. In one implementation the actuator 4 is fixed to the moving support 8, and is not capable of moving in relation to the moving support 8. However, the moving head 3 is not fixed to moving support 8, so that when it is actuated by the actuator 4, the moving head 3 moves in relation to the moving support 8 and the fixed head 1. In one implementation the actuator 4 comprise the connection actuator 6, so that when the connection actuator 6 cooperates with the positioning actuator 5, given that the positioning actuator 5 is disposed in the support structure 7 which remains static at all times, the actuator 4 is not capable of moving and it stays static. As the actuator 4 is not able to move and as it is fixed to the moving support 8, the moving support 8 is not capable of moving either, the moving head 3 not moving and staying disposed in a certain position until the actuator 4 causes movement in order to draw a metal sheet 2.

In one implementation the moving support 8 comprises two longitudinal segments 81 and 82 disposed parallel to one another, the moving head 3 and the actuator 4 being attached to each of the longitudinal segments 81 and 82. In one implementation the moving head 3 comprises a connection member 39 on each side by means of which it is connected to the longitudinal segments 81 and 82 respectively. The longitudinal segments 81 and 82 move in a guided manner and in one implementation comprise for this purpose wheels that move on rails 90 fixed to the floor, although they can also use other equivalent elements to move in a guided manner.

In one implementation the actuator 4 comprises a third head 45 disposed between the fixed head 1 and the moving head 3, the third head 45 coupled to the support structure 7 and having a window 40 through which a metal sheet 2 to be drawn passes. In one implementation the connection actuator 6 is connected to an outer face 45*a* of the third head 45. The connection actuators may also be located in a housing of the third head. In one implementation the connection actuator 6 moves vertically to engage or disengage with the positioning actuator 5. In one implementation the actuator 4 also comprises a plurality of cylinders 49 fixed to the third head 45, which have the task of acting on the moving head 3 and pushing it to cause the movement of the moving head 3 during the drawing of a metal sheet 2. The cylinders 49 are fixed both to the moving head 3 and the third head 45, the movement of the moving head 3 being caused as a result of the actuation of the cylinders 49, as the third moving head 45 is fixed to the positioning actuator 5. In holding the metal sheet 2, the holder 300 exerts a force towards the metal sheet 2, which generates opposing forces on the moving head 3. As stated above, in one implementation the positioning actuator 5 comprises a serrated surface 50 disposed on an upper surface of the upper bars 71 and 72, and on a lower surface of the lower bars 73 and 74. As the serrated surfaces 50 are disposed in this position, the force exerted by the connection actuator 6 to keep the third head 45 fixed counters the forces withstood by the third head 45, compensating for them at least partially. In one implementation the third head 45 is fixed to the moving support 8 by connection members 46 on each side and by means of which it is fixed to the longitudinal segments 81 and 82 of the moving support 8.

What is claimed is:

1. An apparatus for drawing a metal sheet comprising:

a fixed head having a first window through which the metal sheet to be drawn may pass and a first holder for holding a first portion of the metal sheet within the first window during a drawing process, a moving head with a second window through which the metal sheet to be drawn may pass and a second holder for holding a second portion of the metal sheet within the second window during a drawing process, the moving head spaced from the fixed head with the second window having an alignment with the first window, the moving head moveable toward and away from the fixed head, a support assembly attached at one end to the fixed head and extending longitudinally through the second window of the moving head; and an actuator assembly comprising the support assembly that is operable to situate the moving head in different and fixed longitudinal positions relative to the fixed head prior to a drawing process.

2. An apparatus according to claim 1, wherein the second window is substantially rectangular and the support assembly comprises first, second, third and fourth longitudinal bars situated parallel to one another, each of the first, second, third and fourth longitudinal bars being situated at or in close proximity to a corner of the second window.

3. An apparatus according to claim 2, wherein each of the first, second, third and fourth longitudinal bars have an upper surface and a lower surface, the actuator assembly comprises first elements disposed on at least one of the upper and lower surfaces of the first, second, third and fourth longitudinal bars, the actuator assembly further comprising second elements coupled with the moving head, the second elements moveable between a first position and a second position, when in the first position the second elements engage with the first elements to lock the moving head in a longitudinal position relative to the fixed head prior to a drawing process, when in the second position the second elements not engaging the first elements.

4. An apparatus according to claim 3, wherein the first and second elements comprise serrated surfaces.

5. An apparatus according to claim 1, further comprising a third head situated between the fixed head and the moving head, the third head having a third window through which the metal sheet to be drawn may pass, the support assembly extending through the third window, the moving head and third head situated on a common moving support that facilitates a common longitudinal movement of the moving and third heads relative to the fixed head, the common moving support also facilitating longitudinal movement of the moving head relative to the third head.

6. An apparatus according to claim 5, further comprising one or more force inducing members disposed between the third head and the moving head, the force inducing members being extendible and retractable to cause movement between the third head and the moving head.

7. An apparatus according to claim 2, wherein each of the first, second, third and fourth longitudinal bars have first end portions and second end portions, the first end portions being attached to the fixed head, the second end portions being coupled to a floor or a wall.

8. An apparatus according to claim 1, wherein the fixed head is attached to a floor.

9. An apparatus according to claim 8, wherein the first end portions are attached to a face of the fixed head.

10. An apparatus for drawing a metal sheet comprising:

a fixed head having a first window through which the metal sheet to be drawn may pass and a first holder for holding a first portion of the metal sheet within the first window during a drawing process, a moving head with a second window through which the metal sheet to be drawn may pass and a second holder for holding a second portion of the metal sheet within the second window during a drawing process, the moving head spaced from the fixed head with the second window having an alignment with the first window, the moving head moveable toward and away from the fixed head, a support assembly attached at one end to the fixed head and extending longitudinally through the second window of the moving head;

an actuator assembly comprising the support assembly that is operable to situate the moving head in different and fixed longitudinal positions relative to the fixed head prior to a drawing process; and a third head situated between the fixed head and the moving head, the third head having a third window through which the metal sheet to be drawn may pass, the support assembly extending through the third window, the moving head and third head situated on a common moving support that facilitates a common longitudinal movement of the moving and third heads relative to the fixed head, the common moving support also facilitating longitudinal movement of the moving head relative to the third head.

11. An apparatus according to claim 10, wherein the second window is substantially rectangular and the support assembly comprises first, second, third and fourth longitudinal bars situated parallel to one another, each of the first, second, third and fourth longitudinal bars being situated at or in close proximity to a corner of the second window.

12. An apparatus according to claim 11, wherein each of the first, second, third and fourth longitudinal bars have an upper surface and a lower surface, the actuator assembly comprises first elements disposed on at least one of the upper and lower surfaces of the first, second, third and fourth longitudinal bars, the actuator assembly further comprising second elements coupled with the third head, the second elements moveable between a first position and a second position, when in the first position the second elements engage with the first elements to lock the moving support in a longitudinal position relative to the fixed head prior to the drawing process, when in the second position the second elements not engaging the first elements.

13. An apparatus according to claim 12, wherein the first and second elements comprise serrated surfaces.

14. An apparatus according to claim 11, wherein each of the first, second, third and fourth longitudinal bars have first end portions and second end portions, the first end portions being attached to the fixed head, the second end portions being coupled to a floor or a wall.

15. An apparatus according to claim 10, wherein the fixed head is attached to a floor.

16. An apparatus according to claim 15, wherein the first end portions are attached to a face of the fixed head.

* * * * *